United States Patent [19]

Palmere

[11] Patent Number: 4,706,308

[45] Date of Patent: Nov. 17, 1987

[54] SWIMMING POOL LINER AND TILE BORDER RECEPTOR

[76] Inventor: George D. Palmere, 6300 Nightwind Cir., Orlando, Fla. 32818

[21] Appl. No.: 741,128

[22] Filed: Jun. 4, 1985

[51] Int. Cl.[4] ..... E04H 3/18

[52] U.S. Cl. ..... 4/496; 4/503; 4/506; 52/506; 52/513; 52/716; 52/385

[58] Field of Search ..... 4/506, 496, 503, 506, 4/504, 488; 52/169.7, 300, 102, 169.1, 506, 510, 511, 513, 385, 716

[56] References Cited

U.S. PATENT DOCUMENTS

| | | | |
|---|---|---|---|
| 2,082,241 | 6/1937 | Bennett | 52/385 |
| 3,064,273 | 11/1962 | Kwake | 4/506 X |
| 3,239,975 | 3/1966 | Stier | 4/506 X |
| 3,460,705 | 8/1969 | Green | 4/506 X |
| 3,521,419 | 7/1970 | Fornells | 52/506 |
| 3,628,198 | 12/1971 | Katzman | 4/496 X |
| 3,667,177 | 6/1972 | Biela | 4/503 X |
| 3,719,011 | 3/1973 | De Lange | 52/506 X |
| 3,777,318 | 12/1973 | Stillman, Jr. | 4/506 X |
| 3,839,748 | 10/1974 | Stillman, Jr. | 4/506 X |
| 4,000,597 | 1/1977 | Burton | 52/716 |
| 4,064,571 | 12/1977 | Phipps | 52/716 |
| 4,067,155 | 1/1978 | Ruff et al. | 4/503 X |
| 4,154,504 | 5/1979 | Mohs | 52/716 |
| 4,335,474 | 6/1982 | Bailey | 4/506 |
| 4,457,119 | 7/1984 | Dahowski | 4/506 |

*Primary Examiner*—Henry K. Artis

*Attorney, Agent, or Firm*—Duckworth, Allen & Dyer

[57] ABSTRACT

A receptor apparatus useful in combination with swimming pools utilizing a vinyl liner, wherein the receptor apparatus is uniquely designed and configured to retain the free edge of the pool liner and also to provide means for receiving and mounting a tile border around the pool's waterline. The receptor apparatus includes a liner receptor which is mounted around the perimeter of the pool cavity and which retains the free edge of the liner therein, and a tile setting track which is attachable to the edge of the liner, whereby a tile border may be placed in the tile setting track around the pool's waterline.

6 Claims, 6 Drawing Figures

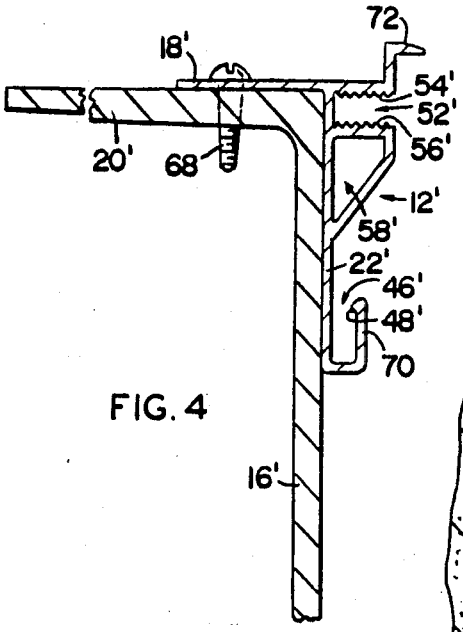
FIG. 4
FIG. 6
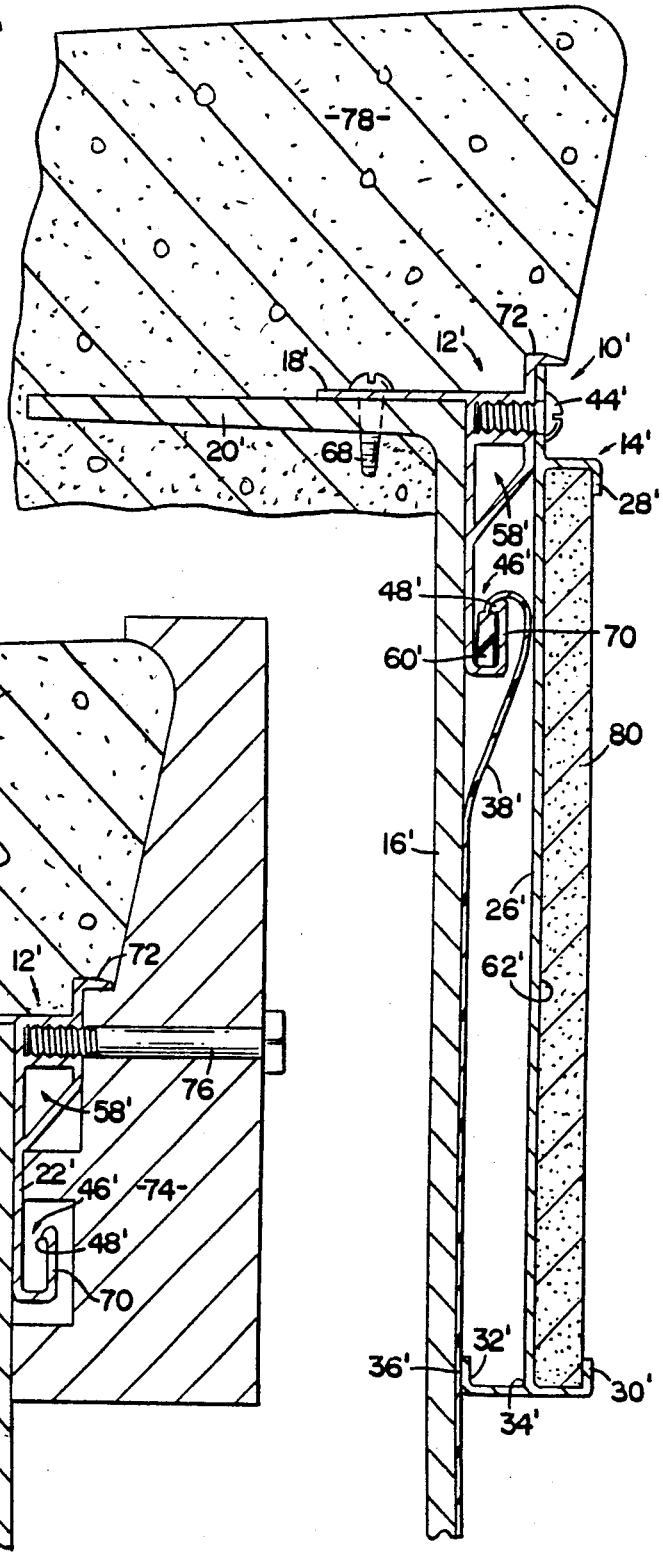
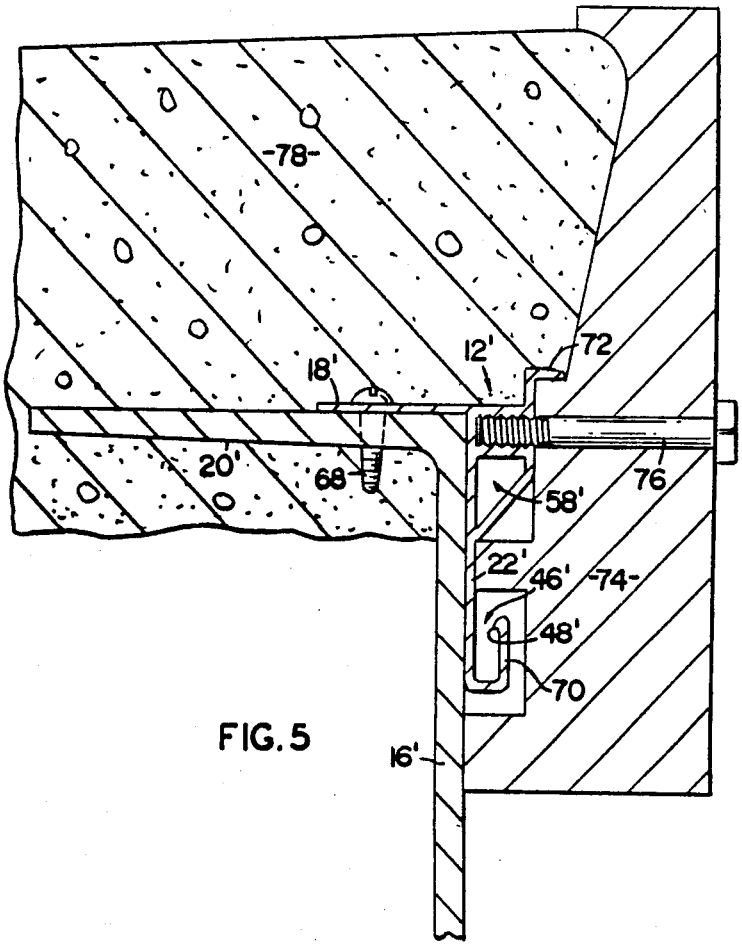
FIG. 5

SWIMMING POOL LINER AND TILE BORDER RECEPTOR

BACKGROUND OF THE INVENTION

The present invention relates to a receptor apparatus for retaining the free edge of a vinyl liner swimming pool and for receiving and mounting a tile border within the pool cavity and around its waterline.

DESCRIPTION OF THE PRIOR ART

Swimming pools utilizing a construction whereby the pool cavity is defined by a vinyl liner utilized to retain water, rather an a concrete shell, are well known in the prior art. Such vinyl liner pools may be installed as "above ground" units or as more standard "in ground" units. Within the environment of "in ground" pools, and specifically with regard to concreteshell pools, it is a standard feature of construction to provide a tile border around the pool's waterline. However, with the vinyl liner "in ground" pools, the use of tile borders is virtually unknown. While there are perhaps many reasons contributing to the normal absence of tile borders in such vinyl liner constructions, two reasons would seem apparent. First, in typical vinyl in ground installations, there simply is not a sufficient supporting surface upon which to mount a tile border. Furthermore, according to present construction techniques, if a tile border were placed around the waterline of a vinyl liner pool, it would be extremely difficult and expensive to remove and replace the vinyl liner at the end of its normal life expectancy or should it become seriously damaged or punctured.

Not surprisingly, prior art patents do teach various means for retaining a vinyl liner around the perimeter of a pool cavity. For example, U.S. Pat. No. 4,064,571 to Phipps discloses a swimming pool liner retainer system wherein the free edge of the pool liner is placed within a first channel, and then a sliding insert is placed within a second channel so as to hold the liner in place and also to overlap and protect the liner edge from deterioration caused by ultra-violet light.

Another construction for a protective coping for a vinyl liner swimming pool is taught in U.S. Pat. No. 3,628,198 to Katzman. According to the teaching of that patent, the protective coping includes a pair of channels. The pool liner is fitted into one of the channels, and a protective panel is snap-fitted into the other channel in overlapping relation to the retained free edge of the liner. According to the disclosure of this patent, the protective panel may be formed to simulate a tile border. However, as is quite apparent from studying the Katzman disclosure, no means are disclosed or suggested for providing a true ceramic tile border.

Other prior art United States patent disclose various means for setting a row of tile along the waterline of poured or cast swimming pool constructions. For example, U.S. Pat. No. 3,850,403 to Stegmeier teaches an apparatus useful both for setting a row of tile along the swimming pool wall and for forming a concrete deck along the top of the wall in overlying relation thereto. The apparatus of Stegmeier, however, would not be suitable for use with vinyl liner pools.Two other U.S. Patents to Stegmeier, U.S. Pat. Nos. 3,850,404 and 3,904,717, disclose other devices useful for placing ceramic tile around the waterline of a concrete swimming pool.

It is, therefore, apparent that there is a great need in the art for apparatus suitable for use in cooperation with vinyl liner swimming pool constructions whereby the free edge of the liner is positively retained in place and whereby decorative ceramic tile, or the like, may be conveniently and efficiently mounted around the pool's waterline in overlaying, protecting relationship to those portions of the liner which otherwise would be exposed to ultra-violot degradation.

SUMMARY OF THE INVENTION

The present invention relates to a receptor apparatus used in cooperation with the support frame of a vinyl liner swimming pool for retaining the free edge of the liner in operative position around the perimeter of the pool cavity and for receiving and mounting a tile border around the pool's waterline in overlying, protecting relation to those portions of the vinyl liner normally extending above the waterline. By virture of the construction of the receptor apparatus of this invention, as is set forth in greater detail below, the aesthetic and decorative qualities of a genuine ceramic tile border are provided while at the same time maintaining and preserving all the inherent advantages of vinyl liner swimming pool construction. Most simply stated, the receptor apparatus of this invention comprises a liner receptor which is attachable to the perimeter of the pool cavity and tile setting track which is then attached to the liner receptor.

The liner receptor is attached to the perimeter of the flat top pool wall panels and comprises a first leg which is actually mounted adjacent the top panel. A body segment is formed at a substantial right angle to the first leg of the liner receptor and depends downwardly therefrom adjacent the interior of the swimming pool wall which defines the pool cavity. While any suitable fastening means may be utilized for the purpose of attaching the first leg of the liner receptor to the top panel of the swimming pool wall, a self-tapping screw fastener is quite acceptable.

A liner receiver means defined by an open channel is formed on the body segment of the liner receptor, and one side of the open channel has a shoulder integrally formed adjacent the open end. The free edge of the pool liner is inserted into the open channel, and the channel shoulder serves to restrain the free edge therein. Also formed on the body segment of the liner receiver is a track receiving means defined by an open slot, the opposing walls of the slot being grooved to receive and engage a fastening means. With relation to both the liner receiver means and the normal waterline of the swimming pool, the track receiving means is formed on the body segment of the liner receptor above both the liner receiver means and the normal waterline. Thus, actual attachment of the tile setting track to the liner receptor will be made above the liner receiver means and, normally, above the waterline.

The tile setting track of the invention comprises a track wall having a first lip formed adjacent the top edge thereof and a second lip formed adjacent the bottom edge thereof. Both the first and second lips extend inwardly of the pool cavity and away from the track wall, whereby a tile border may be attached to the face of the track wall between the first and second lips. At least one mounting aperture is formed throught he track wall whereby a fastening means may be inserted through that aperture in engaging relation to the grooved open slot defining the track receiving means of the liner receptor. Thus, the tile setting track is attached to the liner receptor in substantially overlapping relaiton thereto. The tile setting track further comprises a track brace formed adjacent the bottom edge in opposing relation to the second lip. One end of the track brace is integral with the bottom edge, and a distal end of the track brace abuts the swimming pool wall and the pool liner placed therein.

As will be set forth hereinafter in detailed descriptions of preferred embodiments of the receptor apparatus of this invention, the inventin may be easily and efficiently utilized in combination with vinyl liner pool constructions having cantilevered concrete decks, flush concrete decks, or even brick or tile coping around the pool perimeter. It is also to be understood that both the liner receptor and the tile setting track are preferably formed as extrusions in lengths, for example, of from one foot to as much as eight feet. While the liner receptor and tile setting track may be extruded from any suitable material including both metals and plastics, the use of a nonmetallic material such as, for example, PVC plastic is preferred. Also as will be explained hereinafter, once the liner receptor has been attached to the perimeter of the poolcavity, the liner receptor may be utilized as an anchoring means for the attachment of appropriate forming memebers used to pour the pool deck. Once the deck has set, the forming members may be removed, the vinyl liner operatively installed, and the tile setting track attached to the liner receptor for installation of the tile border.

The invention accordingly comprises the featurers of construction, combination of elements, and arrangement of parts which will be exemplified in the construction hereinafter set forth in the claims.

BRIEF DESCRIPTION OF THE DRAWINGS

For a fuller understanding of the nature and objects of the invention, reference should be had to the following detailed description taken in connection with the accompanying drawings, in which:

FIG. 4 is a sectional view illustrating the attachment of a second embodiment of the liner receptor of this invention to the top wall panel of a vinyl liner swimming pool.

FIG. 5 is a sectional view similar to that of FIG. 4 illustrating the use of the liner receptor as an anchoring means for forming members utilized to pour a cantilevered concrete deck around the perimeter of the vinyl liner pool.

FIG. 6 is a sectional view similar to that of FIGS. 4 and 5 wherein the forming members have been removed and the pool's vinyl liner has been operatively installed and the tile setting track has been mounted onto the liner receptor with a tile border mounted within the tile setting track.

Similar reference characters refer to similar parts throughout the several views of the drawings.

DETAILED DESCRIPTION

Figure 2:
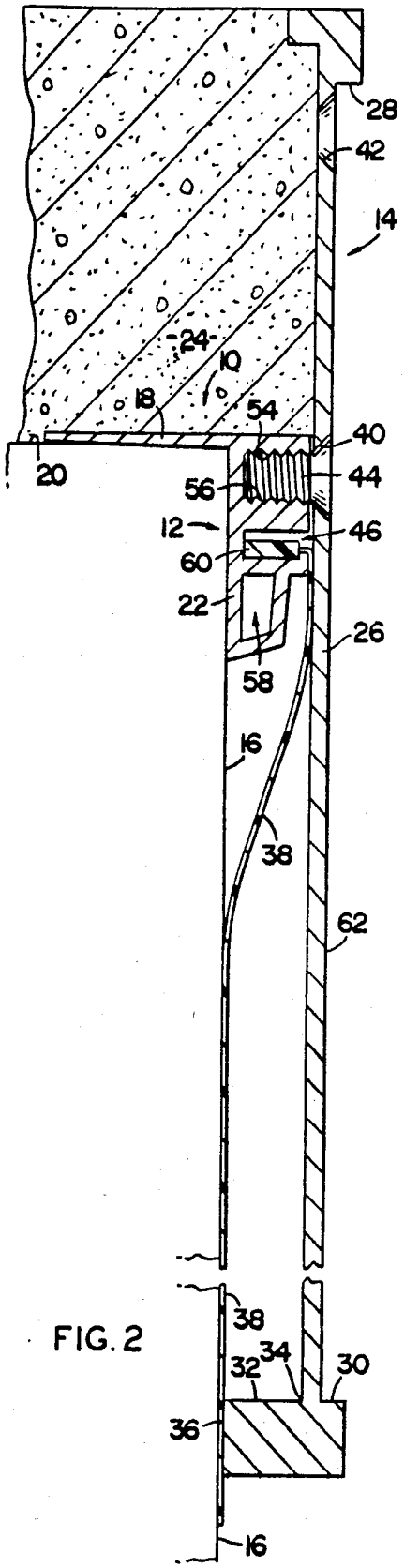
FIG. 2 is a sectional view illustrating the installation and use of the receptor apparatus of this invention in combination with a vinyl liner pool having a concrete deck.
Figure 3:
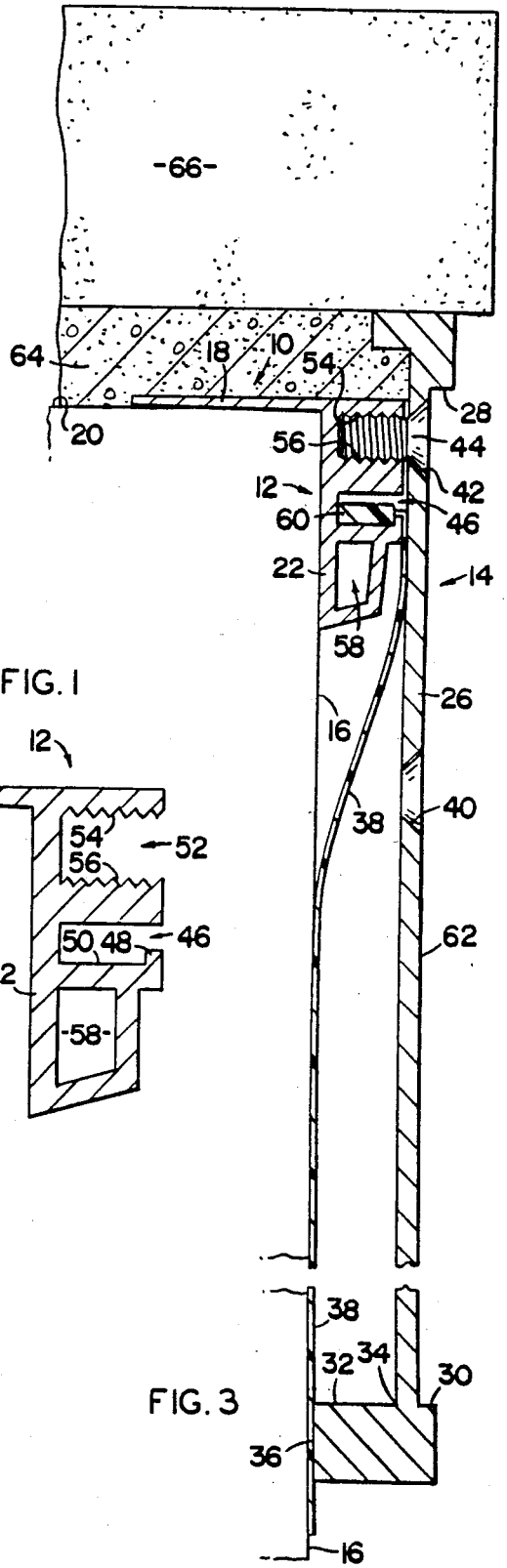
FIG. 3 is a sectional view similar to that of FIG. 2 showing the installation and use of the receptor apparatus in combination with a vinyl liner swimming pool having a brick deck, or coping.

A first embodiment for the receptor apparatus of this invention is generally indicated as 10 in the views of FIGS. 2 and 3. With particular regard to the views of FIGS. 2 and 3, the receptor apparatus 10 comprises a liner receptor generally indicated as 12, and a tile setting track generally indicated as 14. A detailed view, in section, of line receptor 12 is presented in the view of FIG. 1. As seen in FIG. 2, the liner receptor 12 of apparatus 10 is attached to the perimeter of the top panel of the swimming pool wall 16, and liner receptor 12 comprises a first leg 18 disposed adjacent top 20 of wall 16 and a body segment 22 formed at a substantial right angle to first leg 18 and depending downwardly therefrom in juxtaposition to the inside of swimming pool wall 16.

As illustrated in FIG. 2, a concrete deck 24 has been poured, and the tile setting track 14 has been attached to liner receptor 12. Tile setting track 14 comprises a track wall 26 having a first lip 28 formed adjacent the top of track wall 26 and a second lip 30 formed adjacent the bottom of track wall 26. The tile setting track 14 further comprises a track brace 32 formed adjacent the bottom edge of track wall 26 in opposing relation to second lip 30. One end 34 of track brace 32 is integral with the bottom of track wall 26, and distal end 36 of track brace 32 is dimensioned and configured to abut the swimming pool wall 16 and the pool liner 38 placed therein. In the embodiment illustrated in FIGS. 2 and 3, the tile setting track 14 further comprises a first mounting aperture 40 and a second mounting aperture 42 formed through track wall 26 whereby the tile setting track 14 may be attached to the liner receptor 12 as by a threaded fastener 44.

Figure 1:
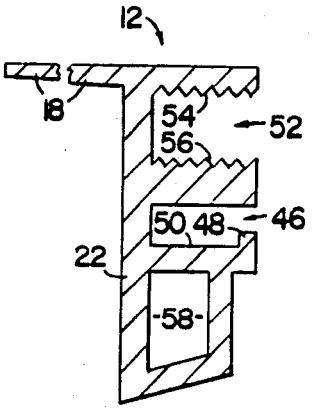
FIG. 1 is a sectional view of a preferred embodiment for the liner receptor of this invention.

Attention is next invited to the view of FIG. 1 wherein the structure and construction of liner receptor 12 is illustrated in greater detail. More particularly, it can be seen that the liner receptor 12 further comprises a liner receiver means generally indicated as 46 and defined by an open channel formed on body segment 22. A shoulder 48 is integrally formed on bottom side 50 at the open end of liner receiver means 46. Liner receptor 12 further comprises track receiving means generally indicated as 52 defined by an open slot formed on body segment 22, opposing walls 54 and 56 being grooved so as to receive and retain a threaded fastener 44 therein. Finally, inasmuch as liner receptor 12 is preferably formed by extrustion, and solely for purposes of saving material while still providing structural strength and rigidity, the illustrated liner receptor 12 includes a trapezoidal closed channel extending along the bottom of body segment 22. However, the scope of the present invention is not to be limited with respect to the presence or absence of cross-sectional configuration of closed channel 58.

Referring once again to the view of FIG. 2, the utility of the receptor apparatus 10 of this invention becomes apparent. Once liner receptor 12 has been installed as shown, the free edge of pool liner 38, including an enlarged portion, or bead 60 formed therearound is inserted into liner receiver means 46 and restrained therein by shoulder 48. Next, tile setting track 14 is attached in overlapping relation to the top portion of pool liner 38 and its bead 60 by inserting a threaded fastener 44 through first mounting aperture 40 into engagement with opposing walls 54 and 56 of track receiving means 52. It should be noted that in this preferred embodiment, threaded fastener 44 is a nylon bolt. Then, though not shown in the view of FIG. 2, ceramic tiles may be placed adjacent to face 62 of track wall 26 between first lip 28 and second lip 30.

The view of FIG. 3 is substantially similar to tht of FIG. 2. However, in the installation of receptor apparatus 12 shown in FIG. 3, there is no concrete decking. Instead, this installation includes a concrete foundation 64 over which brick coping 66 has been placed. Because brick coping 66 extends outwardly toward the pool cavity beyond the tile border (not shown), tile setting track 14 has been attached to liner receptor 12 inserting threaded fastener 44 through second mounting aperture 42.

Having thus set forth a first embodiment for the receptor apparatus 10 of this invention, attention is now invited to the views of FIGS. 4, 5 and 6. Inasmuch as the views of FIGS. 4–6 illustrate a second embodiment for the invention, similar structural elements have been identified by corresponding numerals with the addition of prime mark (').

In FIG. 4, is illustrated the attachment of liner receptor 12' to swimming pool wall 16'. A fastening means, and preferably a self-tapping screw 68 is inserted through first leg 18' of liner receptor 12' into top 20' of the swimming pool wall 16'. Body segment 22' is formed at a substantial right angle to first leg 18' and depends downwardly against pool wall 16' defining the pool's cavity.

In a fashion similar to that of the first embodiment, liner receptor 12' further comprises liner receiver means 46' formed on body segment 22'. A shoulder 48' is integrally formed at the open end of side 70 of the liner receiver means 46'. The liner receptor 12' further comprises track receiving means 52' formed on body segment 22', and defined by an open slot opposing walls 54' and 56' being grooved.

Inasmuch as liner receptor 12' is preferably formed by extrusion, as is liner receptor 12 discussed above, this body segment 22' also defines a trapezoidal closed channel 58' along its length. Finally, liner receptor 12' comprises a lip 72 formed at the top of body segment 22', the utility and function of which will be described hereinafter.

Turning to the view of FIG. 5, forming means comprising a forming block 74 and a form fastener 76 have been mounted onto liner receptor 12' by engaging the threaded end of form fastener 76 into track receiving means 52'. Once forming block 74 has been attached, a cantilevered concrete deck 78 may be poured. Once deck 78 has set sufficiently, form fastener 76 may be removed along with forming block 74, and final installation of the pool's liner and tile border may be accomplished as shown in the view of FIG. 6.

The view of FIG. 6 depicts final, operative installation of the receptor apparatus 10'. Here it can be seen that tile setting track 14' has been attached to liner receptor 12' by threaded fastener 44' . Of course, before tile setting track 14' was so attached, pool liner 38' was first operatively installed by placing bead 60' of its free edge into the open channel defining liner receiver means 46'. Then, and only then was tile setting track 14' attached.

As with the first embodiment, this tile setting track 14' comprises a track wall 26' having a first lip 28' formed adjacent the top edge of track wall 26', and a second lip 30' formed adjacent the bottom edge of the wall 26'. The tile setting track 14' further comprises a track brace 32' formed adjacent the bottom of wall 26', having one end 34' integral with the bottom of wall 26' and a distal end 36' which abuts pool wall 16' and the pool liner 38' placed therein. A tile 80, or a sheet of tiles, is shown as being retained adjacent face 62' of the track wall 26' and between first lip 28' and second lip 30'.

It can thus be seen from the foregoing description that the receptor apparatus of this invention is useful in combination with a variety of vinyl liner swimming pool installations. It is to be remembered that both the liner receptor and the tile setting track of the apparatus are preferably formed by extrusion and would normally be provided to users in lengths of from one to eight feet. Utilizing standard construction techniques, the receptor apparatus of this invention may also be adapted to conform to virtually any shape defined by the pool's cavity including, for example, rectangular, oval, and free form. While the receptor apparatus, and particularly its tile setting track, are primarily intended for use in placing ceramic tile borders around the pool's waterline, the scope of this invention is not to be limited by the particular tile material used. Finally, and with particular regard to the receptor apparatus embodiment shown in the views of FIGS. 4–6, removal of the tile border from the pool will be relatively simple, thereby facilitating necessary repairs or replacement of the vinyl liner.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A pool edge forming apparatus for minimizing solar exposure of plastic used with in-ground vinyl liner swimming pools of the type having at least one layer of poured concrete decking, the apparatus comprising:

(A) a tile setting track having a substantially flat tile backing surface and upper and lower tile retaining lips;

(B) a liner receptor having a first leg for extending horizontally outward from a top planel of a pool and a body segment extending vertically downward from an end of the first leg adjacent the top panel, the body segment including a liner receiver slot for receiving and retaining an upper edge of a vinyl liner and a track receiving means for attachment of the tile setting track, said receptor being maintained in fixed position about the pool by an overlaying of the at least one layer of poured concrete decking; and (C) means for attaching said tile setting track to said liner receptor, said track covering the receptor body segment and at least that portion of the vinyl liner normally above water and said track being protected from solar rays by tile inserted therein.

2. The apparatus of claim 1 wherein said track has an upper portion thereof extending above said receptor said upper portion acting as a form for defining an edge of the poured concrete decking around the pool.

3. The apparatus of claim 1 and including forming means for attachment to said receptor, said forming means having an upwardly extending portion defining a coping edge for the pool and adapted to support the poured concrete decking while hardening, said forming means having a portion mating with said receptor for establishing an attachment zone for said track when said forming means is removed.

4. The apparatus of claim 1 wherein said attaching means comprises a plurality of spaced threaded apertures formed in said body segment and a corresponding plurality of mating apertures formed through said track, said track being attached to said receptor by screws threaded through said track into said receptor.

5. The apparatus of claim 1 wherein said receptor is attached to the pool top panel by screws extending through said first leg into the panel, the concrete being poured over the screw and first leg.

6. A receptor apparatus as in claim 1 wherein said tile setting track further comprises a track brace formed adjacent said bottom edge in opposing relation to said lower lip, one side of said track brace being integral with said bottom edge and a distal side of said track brace abutting the swimming pool top panel and the pool vinyl liner placed therein, said brace extending outwardly coextensive with the extension of said receptor body segment into the pool, said brace cooperating with said body segment to support said track in a plane substantially parallel to the top panel.

* * * * *